US008567316B2

(12) United States Patent
Hieronymus et al.

(10) Patent No.: US 8,567,316 B2
(45) Date of Patent: Oct. 29, 2013

(54) METHOD FOR CONTROLLING A TEMPERATURE OF A PRESS AND PRESS HAVING A TEMPERATURE CONTROL DEVICE

(75) Inventors: Jens Hieronymus, Darmstadt (DE); Jürgen Michels, Dossenheim (DE); Dieter Schaffrath, Lorsch (DE); Wolfgang Schönberger, Schriesheim (DE); Bernhard Schwaab, Neustadt (DE); Michael Thielemann, Heidelberg (DE)

(73) Assignee: Heidelberger Druckmashinen Aktiengesellschaft, Heidelberg (DE)

( * ) Notice: Subject to any disclaimer, the term of this patent is extended or adjusted under 35 U.S.C. 154(b) by 1267 days.

(21) Appl. No.: 11/526,449

(22) Filed: Sep. 25, 2006

(65) Prior Publication Data

US 2007/0068409 A1 Mar. 29, 2007

(30) Foreign Application Priority Data

Sep. 27, 2005 (DE) ..... 10 2005 046 096

(51) Int. Cl.
*B41F 31/00* (2006.01)

(52) U.S. Cl.
USPC ..... 101/487; 101/349.1

(58) Field of Classification Search
None
See application file for complete search history.

(56) References Cited

U.S. PATENT DOCUMENTS

| | | | | |
|---|---|---|---|---|
| 3,956,986 | A * | 5/1976 | Wirz et al. | 101/350.3 |
| 5,218,905 | A | 6/1993 | Bolte et al. | |
| 5,233,921 | A | 8/1993 | John | |
| 6,065,402 | A | 5/2000 | Feller et al. | |
| 6,098,540 | A | 8/2000 | Vrotacoe et al. | |
| 6,109,177 | A * | 8/2000 | Wech et al. | 101/349.1 |
| 6,505,557 | B2 * | 1/2003 | Desaulniers et al. | 101/487 |
| 6,668,724 | B2 | 12/2003 | Callahan et al. | |
| 2002/0178954 | A1 | 12/2002 | Hayashi et al. | |

FOREIGN PATENT DOCUMENTS

| | | | |
|---|---|---|---|
| DE | 85 33 004 | U1 | 5/1988 |
| DE | 197 53 931 | A1 | 8/1998 |
| DE | 197 17 524 | A1 | 11/1998 |
| DE | 197 36 339 | A1 | 4/1999 |
| DE | 101 60 734 | A1 | 7/2002 |
| DE | 101 43 827 | A1 | 3/2003 |
| EP | 0 870 609 | A2 | 10/1998 |
| JP | 3176154 | A | 7/1991 |
| JP | 8011293 | A | 1/1996 |
| JP | 2000052625 | A | 2/2000 |
| JP | 2002347214 | A | 12/2002 |

OTHER PUBLICATIONS

English translation of the Chinese Office Action dated Jun. 11, 2009.

* cited by examiner

*Primary Examiner* — Jill Culler

(74) *Attorney, Agent, or Firm* — Laurence A. Greenberg; Werner H. Stemer; Ralph E. Locher

(57) ABSTRACT

In a method for controlling the temperature of a press which has an applicator roller and a screen roller, the screen roller has its temperature controlled at different temperatures and the applicator roller has its temperature controlled at a constant temperature. In this manner, the choice of the screen roller temperatures can be set individually for each printing unit depending on the optical ink density values which the operator desires.

6 Claims, 1 Drawing Sheet

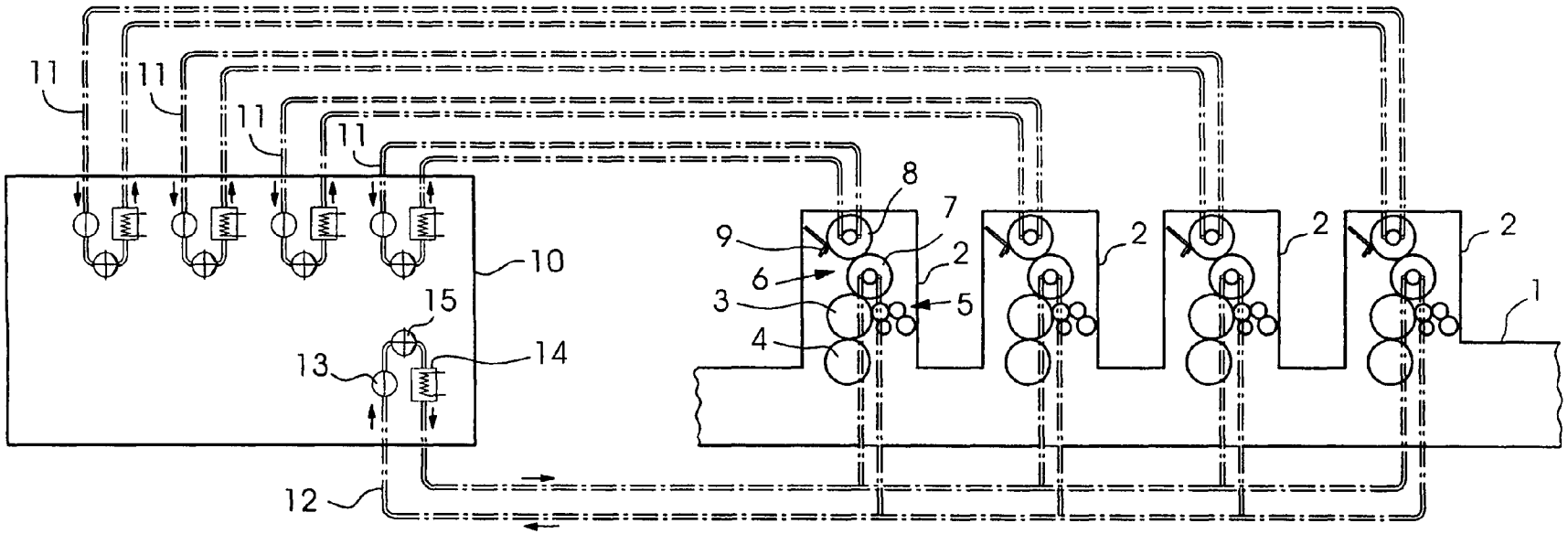
1
2
2
2
2
5
7
8
9
6
3
4
10
14
15
11
11
11
11
13
12

METHOD FOR CONTROLLING A TEMPERATURE OF A PRESS AND PRESS HAVING A TEMPERATURE CONTROL DEVICE

BACKGROUND OF THE INVENTION

Field of the Invention

The present invention relates to a method for controlling a temperature of a press and to a press having a temperature control device.

German patent DE 197 36 339 B4 describes a press in which a screen roller and an ink applicator roller have their temperature controlled.

German Utility Model DE 85 33 004 U1 describes a press in which a screen roller has its temperature controlled at a preselectable temperature.

Published, European patent application EP 0 870 609 A2 describes a press which contains offset printing units having anilox inking units.

Still unsolved by the aforementioned prior art is the problem of the ink control being influenced by too many influencing factors.

SUMMARY OF THE INVENTION

It is accordingly an object of the invention to provide a method for controlling the temperature of a press and a press having a temperature control device which overcome the above-mentioned disadvantages of the prior art methods and devices of this general type, by which the ink control can be simplified.

In the method according to the invention for controlling the temperature of a press which contains an applicator roller and a screen roller, the screen roller has its temperature controlled at different temperatures and the applicator roller has its temperature controlled at a constant temperature.

In the method according to the invention, therefore, the screen roller has its temperature variably controlled and the applicator roller has its temperature constantly controlled. As a result, it is possible to concentrate the decisive factors for the specific ink control on a single roller nip, namely the roller nip formed by the screen roller together with the applicator roller. The temperature difference acting in the roller nip between the temperature of the screen roller and the temperature of the applicator roller can be varied by the variation of the screen roller temperature, in order specifically to vary the quantity of ink transferred from the screen roller to the applicator roll. This is possible exactly and with a quick reaction and without any thermal impairment of the ink transfer in the roller nip formed by the applicator roller together with a printing form cylinder.

In one development, the screen roller has its temperature controlled at temperatures which are different from print job to print job.

In a further development, the applicator roller has its temperature controlled at a temperature that remains constant from print job to print job.

In a further development, the press contains a further applicator roller and a further screen roller, and the screen roller has its temperature controlled at a different temperature than the further screen roller.

In a further development, the applicator roller has its temperature controlled at the same temperature as the further applicator roll.

In a further development, the two screen rollers have their temperature controlled by separate temperature control medium circuits.

In a further development, the two applicator rollers have their temperature controlled by a common temperature control medium circuit.

The invention also includes a press which contains a temperature control device which is configured to implement the method according to the invention or one corresponding to one of the developments.

Other features which are considered as characteristic for the invention are set forth in the appended claims.

Although the invention is illustrated and described herein as embodied in a method for controlling the temperature of a press and a press having a temperature control device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The single FIGURE of the drawing is a diagrammatic illustration of a printing press according to the invention.

DESCRIPTION OF THE PREFERRED EMBODIMENT

Referring now to the single FIGURE of the drawing in detail thereof, there is shown a press 1 having at least four printing units 2 for four-color printing. The press 1 is a sheet-fed press of series construction. A sheet feeder and a sheet deliverer of the press 1 are not illustrated by drawing, for reasons of simplicity. The printing units 2 are lithographic offset printing units and each contain a printing form cylinder 3, a blanket cylinder 4, a damping unit 5 and an inking unit 6. In addition, each printing unit 2 contains an impression cylinder but the impression cylinders are not illustrated for reasons of illustrative simplification.

The inking units 6 are anilox inking units and each contain an applicator roller 7, a screen roller 8 and an inking device 9 resting on the screen roller 8. The applicator roller 7 and screen roller 8 of each printing unit 2 rest on one another without any bearer rings, that is to say the two rollers are not provided with a type of bearer ring. Only a single applicator roller 7 rests on each screen roller 8 and, during printing operation, on each printing form cylinder 3. The applicator rollers 7 have the same diameter as the printing form cylinders 3. The ink feed devices 9 are ink containers open at the top and have a single doctor blade.

The press 1 also includes a temperature control device 10, which contains separate circuits 11 for controlling the temperature of the screen rollers 8, and a common circuit 12 for controlling the temperature of the applicator rollers 7. Thus, each screen roller 8 is integrated into a different separate circuit 11, and all the applicator rollers 7 are integrated into one and the same common circuit 12 by a parallel connection. The separate circuits 11 and the common circuit 12 each contain a pump 13 for delivering the temperature control medium (preferably water) through the respective circuit and the roller integrated into the latter. In addition, the separate circuits 11 and the common circuit 12 each contain a heating device 14 for heating the circulating temperature control medium and a measuring device 15 for measuring the temperature of the temperature control medium. In the FIGURE, the flow directions of the temperature control mediums circulated in the circuits 11, 12 are indicated by arrow symbols.

The blanket cylinders 4 and the damping units 5 are also connected to the temperature control device 10; the circuits of the temperature control device 10 which are present for this purpose are not illustrated by drawing, however, for reasons of simplification. The control of the temperature of the damping unit 5 is used for the indirect control of the temperature of the printing form cylinder 3 via the damping agent applied to the printing form cylinder 3 by the damping unit 5, in order to keep the temperature of the printing form cylinder 3 constant. The control of the temperature of the blanket cylinders 4 is used to complete the control of the temperature of the printing unit.

The system illustrated functions as now described.

The heating device 14 and a measuring device 15 of the common circuit 12 are connected together to form a closed control loop, which keeps the temperature of the temperature control medium of the common circuit 12 and thus the applicator rollers 7 constant to a value of about 30° C. The temperature of the applicator rollers 7 of about 30° C. does not differ from printing unit 2 to printing unit 2. The heating device 14 and the measuring device 15 of each separate circuit 11 are connected together to form a closed control loop, which keeps the temperature control medium and screen roller temperature of the respective separate circuit 11 constant at a value that can be set by the operator on the operating desk of the press 1. The temperatures of the separate circuits 11, which can be preselected by the operator within a temperature range of 20° C. to 45° C., differ from one another from printing unit 2 to printing unit 2. The choice of the screen roller temperatures that can be set individually for each printing unit 2 depends on the optical ink density values which the operator measures on the printing material sheet when setting up the press 1 and during continuous printing.

If, for example, the circulation temperature of the temperature control medium in one of the separate circuits 11 is to be reduced quickly, then this is done by deliberately pumping cold temperature control medium into the corresponding separate circuit 11. The cold water feeds and warm water discharges which are required for this purpose and to which the separate circuits 11 are connected are not illustrated for reasons of illustrative simplification.

If, for example, the optical ink density in a specific printing unit 2 is to be increased and is to be maintained unchanged in the remaining printing units 2, then the ink density increase is effected by increasing the output of the heating device 14 of the separate circuit 11 of the specific printing unit 2, the settings of the heating devices 14 of the remaining separate circuits 11 being left unchanged.

This application claims the priority, under 35 U.S.C. §119, of German application DE 10 2005 046 096.8, filed Sep. 27, 2005; the prior application is herewith incorporated by reference in its entirety.

We claim:

1. A method for controlling a temperature of a press having an applicator roller, a printing form cylinder, a screen roller, a further applicator roller, a further printing form cylinder, and a further screen roller, which comprises the step of:

controlling a temperature of the screen roller at different temperatures;

controlling the temperature of the screen roller at a different temperature than a temperature of the further screen roller;

controlling the temperature of the screen roller and the further screen roller with respective separate temperature control medium circuits having temperature control medium flowing therein;

during printing operation, resting the applicator roller on the printing form cylinder and resting the further applicator roller on the further printing form cylinder;

controlling a temperature of the applicator roller at a constant temperature; and controlling the temperature of the applicator roller and the further applicator roller with a single same temperature control medium circuit having temperature control medium flowing therein.

2. The method according to claim 1, which further comprises controlling the temperature of the screen roller at temperatures which are different from print job to print job.

3. The method according to claim 1, which further comprises controlling the temperature of the applicator roller at a temperature that remains constant from print job to print job.

4. The method according to claim 1, wherein the applicator roller and the further applicator roller are integrated into the single same temperature control medium circuit by a parallel connection.

5. A method for controlling a temperature of a press having an applicator roller, a printing form cylinder, a screen roller, a further applicator roller, a further printing form cylinder, and a further screen roller, which comprises the step of:

controlling a temperature of the screen roller at different temperatures;

controlling the temperature of the screen roller at a different temperature than a temperature of the further screen roller;

controlling the temperature of the screen roller and the further screen roller with respective separate temperature control medium circuits having temperature control medium flowing therein;

during printing operation, resting the applicator roller on the printing form cylinder and resting the further applicator roller on the further printing form cylinder;

controlling a temperature of the applicator roller at a constant temperature; and controlling the temperature of the applicator roller and the further applicator roller with a single same temperature control medium circuit having temperature control medium flowing therein;

controlling the temperature of the applicator roller at a same temperature as the further applicator roller.

6. The method according to claim 5, wherein the applicator roller and the further applicator roller are integrated into the single same temperature control medium circuit by a parallel connection.

* * * * *